US007984743B2

(12) United States Patent
Rossato

(10) Patent No.: US 7,984,743 B2
(45) Date of Patent: Jul. 26, 2011

(54) SHADE CONSTRUCTION

(75) Inventor: Alejandro Martin Rossato, Greensboro, NC (US)

(73) Assignee: Newell Window Furnishing, Inc., High Point, NC (US)

( * ) Notice: Subject to any disclaimer, the term of this patent is extended or adjusted under 35 U.S.C. 154(b) by 176 days.

(21) Appl. No.: 11/470,652

(22) Filed: Sep. 7, 2006

(65) Prior Publication Data

US 2008/0083508 A1 Apr. 10, 2008

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |

(52) U.S. Cl. ..... 160/84.05; 160/84.03

(58) Field of Classification Search ..... 160/84.05, 160/84.04, 84.03, 115

See application file for complete search history.

(56) References Cited

U.S. PATENT DOCUMENTS

| | | | | |
|---|---|---|---|---|
| 1,937,342 | A * | 11/1933 | Higbie | 359/596 |
| 4,143,907 | A | 3/1979 | Ireland | |
| 4,647,488 | A | 3/1987 | Schnebly et al. | |
| 4,677,012 | A * | 6/1987 | Anderson | 428/116 |
| 4,813,468 | A * | 3/1989 | Fraser | 160/84.03 |
| 5,355,928 | A * | 10/1994 | Robertson | 160/84.04 |
| 5,706,876 | A | 1/1998 | Lysyj | |
| 5,974,763 | A | 11/1999 | Colson et al. | |
| 6,052,966 | A | 4/2000 | Colson et al. | |
| 6,068,039 | A | 5/2000 | Judkins | |
| 6,095,222 | A | 8/2000 | Voss | |
| 6,103,336 | A | 8/2000 | Swiszcz | |
| 6,164,362 | A | 12/2000 | Yang | |
| 6,328,090 | B1 * | 12/2001 | Anderson et al. | 160/84.05 |
| 6,345,486 | B1 * | 2/2002 | Colson et al. | 52/793.1 |
| 6,354,353 | B1 | 3/2002 | Green et al. | |
| 6,412,537 | B1 | 7/2002 | Voss et al. | |
| 6,550,519 | B2 | 4/2003 | Green et al. | |
| 6,550,520 | B1 | 4/2003 | Rossini et al. | |
| 6,568,453 | B2 * | 5/2003 | Zorbas | 160/84.05 |
| 6,688,373 | B2 | 2/2004 | Corey et al. | |
| 6,740,389 | B2 | 5/2004 | Yu | |
| 6,837,294 | B2 | 1/2005 | Cheng et al. | |
| 2002/0011314 | A1 | 1/2002 | Voss et al. | |
| 2002/0043346 | A1 | 4/2002 | Zorbas | |

(Continued)

OTHER PUBLICATIONS http://www.aceblind.com/topdown.htm printed Jan. 13, 2006.

(Continued)

*Primary Examiner* — Blair M Johnson
*Assistant Examiner* — Jeremy C Ramsey
(74) *Attorney, Agent, or Firm* — Dennis J. Williamson; Matthew W. Witsil; Moore & Van Allen PLLC

(57) ABSTRACT

A shade comprises a head rail that supports the lift cords for a shade panel. The shade panel includes a plurality of cells secured to one another. A bottom rail is secured to the lower edge of the panel and to which the lift cords are connected for raising and lowering the bottom of the shade panel. The upper edge of the panel is defined by a horizontally extending top cell that is substantially the same as the other cells that create the panel. A rigid bar insert is located within the top cell that extends for substantially the entire length of the top cell. The lift cords for raising and lowering the upper edge of the panel extend through the top cell and are connected to the bar.

16 Claims, 5 Drawing Sheets

U.S. PATENT DOCUMENTS

| | | | | |
|---|---|---|---|---|
| 2002/0074092 | A1* | 6/2002 | Shen | 160/84.01 |
| 2003/0062136 | A1* | 4/2003 | Nien | 160/84.04 |
| 2003/0070767 | A1* | 4/2003 | Workman et al. | 160/84.04 |
| 2004/0020604 | A1 | 2/2004 | Allsopp | |
| 2004/0074611 | A1 | 4/2004 | Colson et al. | |
| 2004/0231803 | A1 | 11/2004 | Cheng et al. | |
| 2004/0250963 | A1* | 12/2004 | Hsu | 160/84.03 |
| 2005/0224189 | A1 | 10/2005 | Chang et al. | |
| 2006/0048904 | A1* | 3/2006 | Gruner | 160/84.05 |
| 2006/0219370 | A1* | 10/2006 | Pon | 160/168.1 R |
| 2008/0173409 | A1* | 7/2008 | Robertson et al. | 160/84.01 |

OTHER PUBLICATIONS http://www.theblindalley.com/blinds/hunterdouglas/applause/options.html printed Jan. 13, 2006.
http://www.yourblinds.com/products/cellular/hunter_douglas/hdcs1001.asp printed Jan. 13, 2006.
http://www.windovango.com/shades.htm printed Jan. 13, 2006.
Mexican Patent Office, Office Action, Aug. 8, 2009.

* cited by examiner

SHADE CONSTRUCTION

The invention relates generally to window coverings and more particularly to an improved shade design.

BACKGROUND OF THE INVENTION

Moveable window coverings such as blinds, shades and the like are well known. One type of window covering is the cellular or honeycomb shade. This type of window covering typically comprises a shade panel constructed of woven or non-woven material formed into a plurality of contiguous horizontally extending cells. In cross-section, the cells typically have a polygonal shape such as a heptagon. The cells provide insulation and prevent light penetration. Plural layers of cells may be used in the panel to increase the insulating and light impermeability characteristics of the panel.

In a typical bottom up shade, the shade panel is supported along its upper edge by a head rail and has its lower edge secured to a bottom rail. The head rail is secured to an architectural feature such as a window frame to support the window covering adjacent to the architectural feature being covered. A plurality of lift cords extend from the head rail and are connected to the bottom rail to raise and lower the bottom rail thereby opening and closing the window covering. In one typical arrangement the lift cords are connected to draw cords that extend from the head rail such that they can be grasped by a person to cause the blinds to raise and lower. In some embodiments the lift cords and draw cords are formed of the same cord. It is also known to use a spring motor or an electric motor to raise and lower the blinds. As the blind panel is moved from an extended or closed position to a retracted or open position, the panel material folds to collapse the cells against the head rail.

Top down/bottom up shades are also known where the upper edge of the shade panel can be raised and lowered relative to the head rail in addition to the bottom rail being moved relative to the head rail as previously described. In existing top down/bottom up constructions, a middle rail is used that is secured to the upper edge of the shade. A second set of lift cords are connected to the middle rail to raise and lower the middle rail relative to the head rail. When the top of the shade is raised, the middle rail abuts the head rail such that the two rails are disposed adjacent to one another. Further when the panel is lowered, both the middle rail and the head rail are clearly visible where the middle rail is disposed across the architectural feature being covered.

Another similar shade is commonly referred to as a day/night shade. The day/night shade has a head rail, middle rail and bottom rail arranged as described above for the top down/bottom up shade. In the typical day/night shade a second shade panel is disposed between the head rail and the middle rail where the second shade panel is of a different construction or material than the first shade panel. For example, the second shade panel may allow more or less light to pass through than the first shade panel. When the middle rail is raised the first or lower panel is expanded and the second or upper shade is retracted and when the middle rail is lowered the first or lower panel is retracted and the second or upper shade is expanded. The middle rail is exposed in the various orientations of the window covering.

The use of the middle rail creates an unaesthetic appearance because this rail, in addition to the head rail and bottom rail, is exposed. While the middle rail may be colored or covered in material, the shape and finish of the rail does not "match" the shape, design and/or material of the panel. Further, when the upper edge of the panel is fully raised, the middle rail abuts the head rail. This exposes a relatively large area of rail that presents a noticeably different visual appearance than a standard cellular shade. Moreover, because the head rail and top rail are typically made of a rigid material such as aluminum, the abutting contact between these elements often creates gaps that allow streams of light to penetrate the window covering.

Thus, an improved shade is desired.

SUMMARY OF THE INVENTION

The shade of the invention comprises a head rail that supports the lift cords for the shade panel and that is mounted to a wall, window frame, door or other architectural feature. The shade panel includes a plurality of horizontally extending substantially contiguous cells. A bottom rail is secured to the lower edge of the panel and to which the lift cords are connected for raising and lowering the bottom of the shade panel. The upper edge of the panel is defined by a horizontally extending top cell that is substantially the same as the other cells that create the panel. A rigid bar insert is located inside of the top cell that extends for substantially the entire width of the panel. The lift cords for raising and lowering the upper edge of the panel extend through the top cell and are connected to the bar. In one embodiment, the bar has a cross-sectional profile that conforms to a portion of the shape of the cell in which it is located such that the bar supports and maintains the shape of the cell.

DETAILED DESCRIPTION OF EMBODIMENTS OF THE INVENTION

Figure 1:
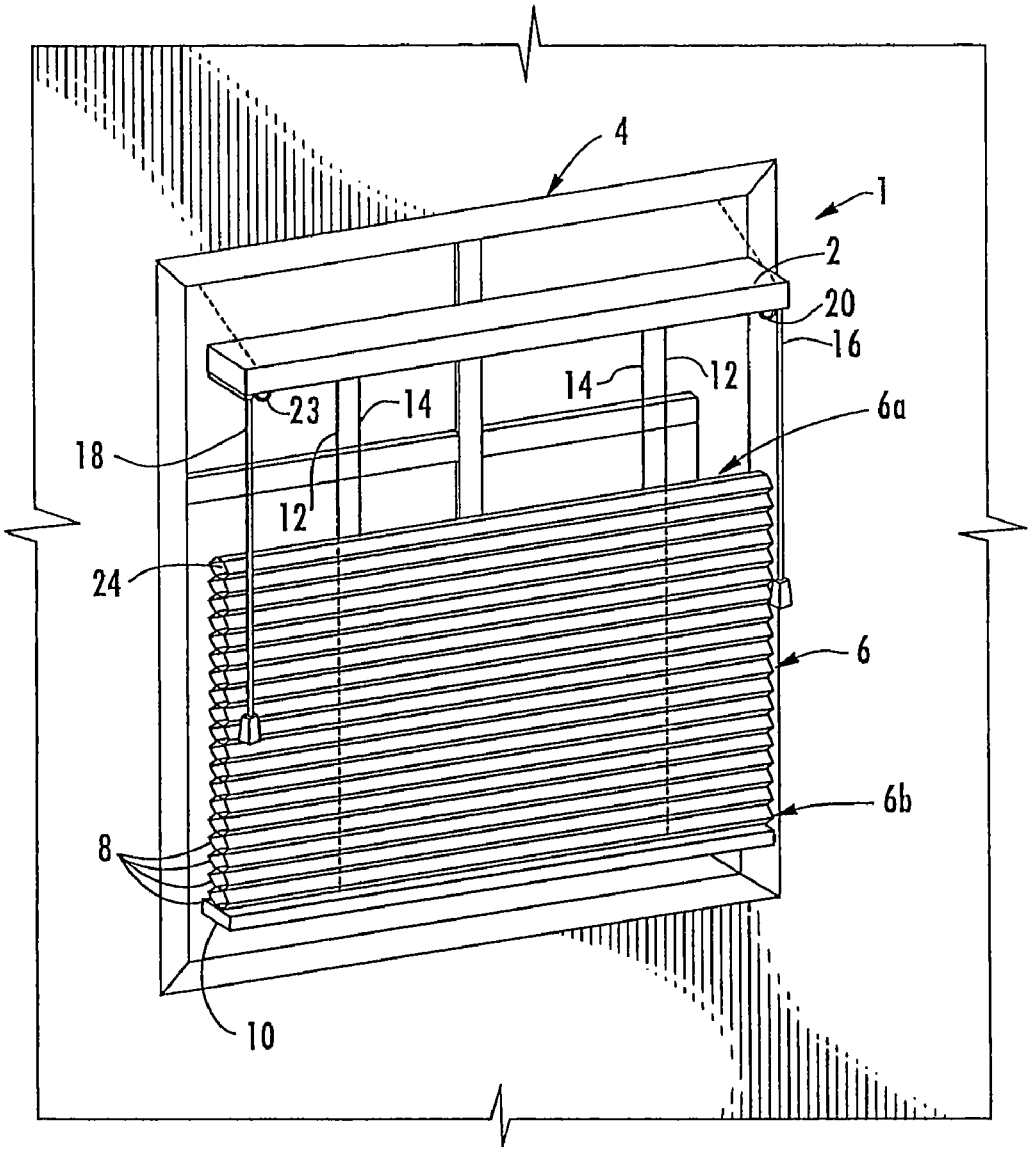
FIG. 1 is a perspective view of an embodiment of a top down/bottom up shade of the invention.

The window covering of the invention is shown generally at 1 in FIG. 1 and includes a head rail 2 made of a rigid material such as aluminum, wood or the like. The head rail 2 is typically mounted to an architectural feature 4 such as a window such that the window covering may selectively cover the feature. While the window covering 1 is shown with a window it is to be understood that the architectural feature may be a door, alcove or any other feature. The head rail 2 is typically secured to the architectural feature using releasable brackets (not shown) such that the window covering may be removably mounted although any mounting mechanism may be used.

Figure 5:
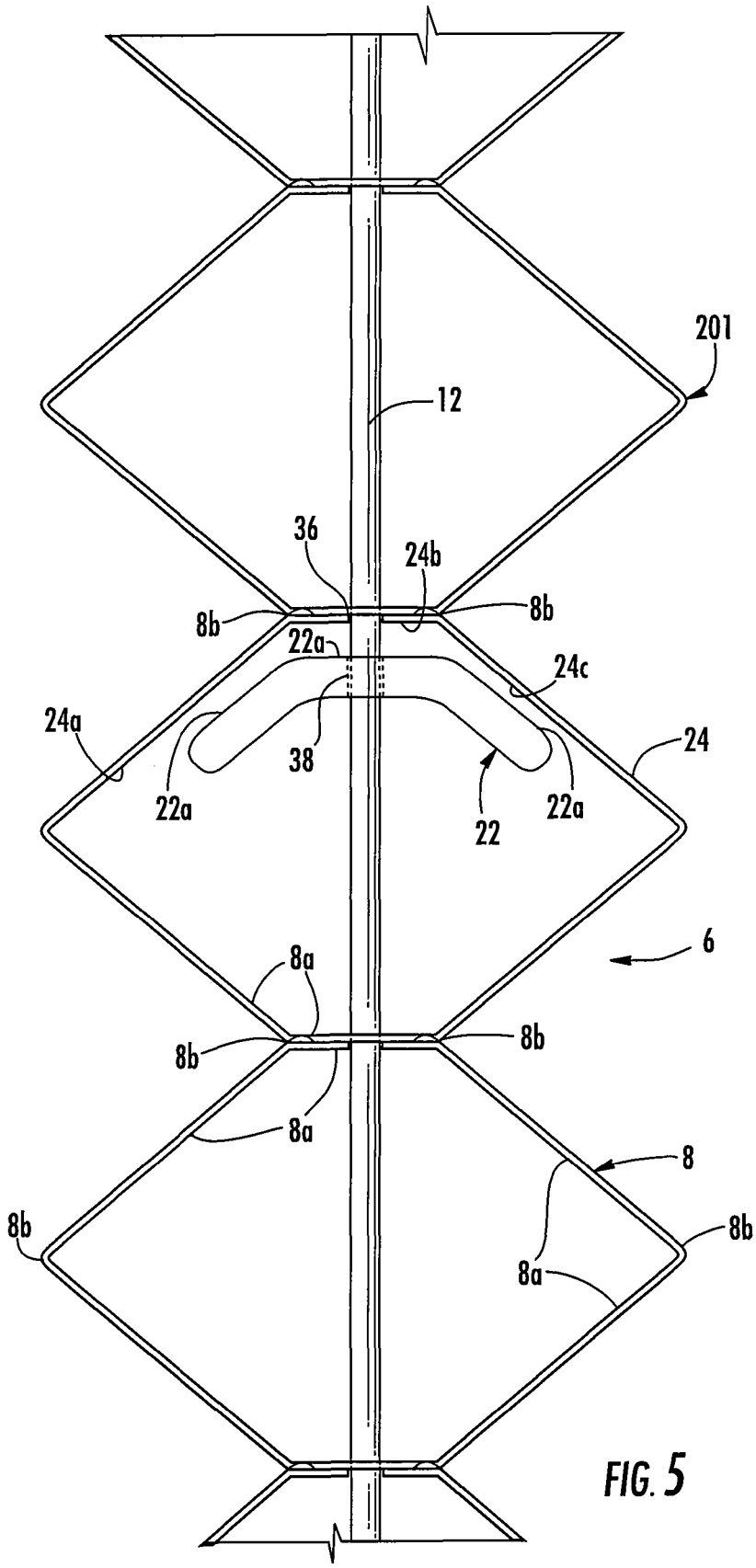
FIG. 5 is a side view of the embodiment shown in FIG. 2.

Supported on the head rail 2 is a shade panel 6 consisting of a plurality of cells 8 that extend for substantially the width of the panel. The panel 6 has an upper edge 6*a* that is disposed closer to head rail 2 than the panel lower edge 6*b*. The panel 6 may be made of a woven or non-woven material that is constructed to form the substantially contiguous cells 8 where the cells have a polygonal cross-sectional shape and extend substantially parallel to the head rail 2. Referring to FIG. 5, each cell 8 is formed of a plurality of faces 8*a* that are joined at fold lines 8*b* such that the cell can collapse when the shade is retracted and expand when the shade is extended. While cells 8 having six faces are illustrated it is to be understood that the cells may have a fewer or greater number of faces and that the specific shape of the cells can vary. The interior of each cell 8 is typically open although it is known to include additional layers of material inside the cells to increase thermal insulation or light impermeability. Moreover, while a single cell configuration is illustrated the shade of the invention may be configured as a double or triple cell shade. A double cell configuration has two layers of cells while a triple cell configuration has three layers of cells. The cellular panel 6 may be created by any known method and is typically made by stitching, gluing, mechanically fastening or otherwise joining multiple pieces of the material together to form the cells.

Referring again to FIG. 1, a bottom rail 10 is secured to the lower edge 6*b* of the panel 6 by adhesive, mechanical connection or other securing device. The bottom rail 10 may be formed of aluminum, wood or other rigid material. The bottom rail 10 adds weight to the panel 6 to assist in the lowering of the panel and maintains the shape of the panel.

The panel 6 is supported on head rail 2 by a first pair of lift cords 12 and a second pair of lift cords 14. The lift cords 12 are connected to the bottom rail 10 and are used to raise and lower the lower edge 6*b* of the panel 6. The second pair of lift cords 14 are secured to the uppermost cell 24 located at the upper edge 6*a* of the panel 6 as will hereinafter be described to raise and lower the upper edge of the panel. The lift cords 12 and 14 extend into the head rail 2 and are connected to draw cords 16 and 18, respectively, that are manipulated by the user to raise and lower the lower edge of the panel and the upper edge of the panel, respectively. Pulling on draw cord 16 will cause lift cords 12 to raise the lower edge of panel 6 and pulling on draw cord 18 will cause lift cords 14 to raise the upper edge of panel 6. Releasing the draw cords 16 and/or 18 allows the upper and lower edges of the panel to extend away from the head rail 2. In some embodiments the lift cords and draw cords consist of a common element such that, for example, each lift cord 12 extends through the head rail to form draw cord 16 and each lift cord 14 extends through the head rail and to form draw cord 18. The head rail 2 typically includes spools or other mechanisms over which the cords are wound and lock mechanisms 20 and 23 for locking the blind panel 6 in the desired position. In one embodiment the lock mechanisms 20 and 23 releasably secure the draw cords 16 and 18 to lock the panel 6 in position.

Figure 2:
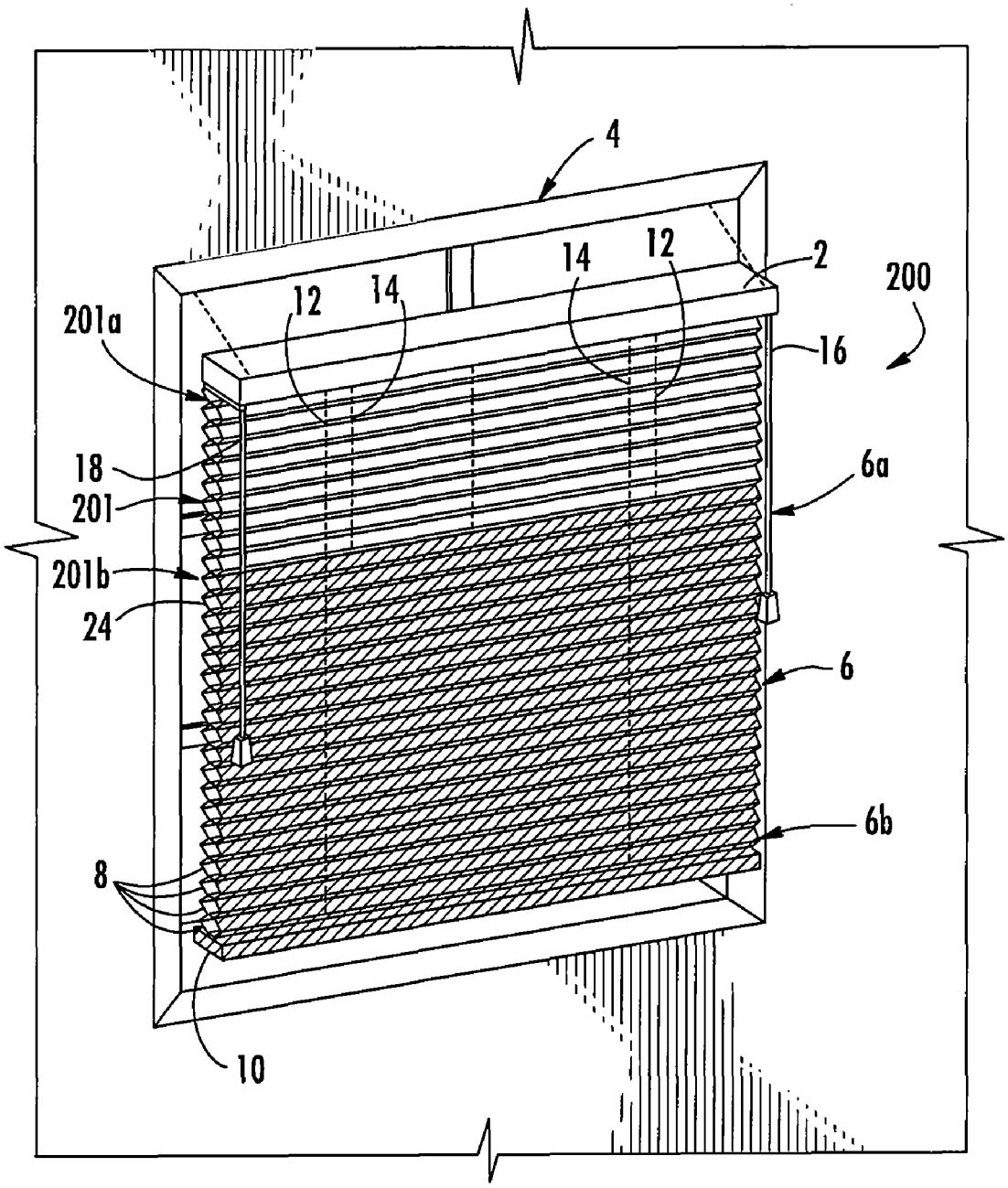
FIG. 2 is a perspective view of an embodiment of a day/night shade of the invention.

Referring to FIG. 2 a day/night shade is shown generally at 200 where like reference numerals are used to refer to like components previously described with respect to the shade of FIG. 1. The difference between the day/night shade 200 shown in FIG. 2 and the top down/bottom up shade 1 previously described with respect to FIG. 1 is the addition of a second shade 201. The upper edge 201*a* of shade 201 is connected to the head rail 2 and the lower edge 201*b* of shade 201 is connected to the uppermost cell 24 of shade 6. As the upper edge 6*a* of shade 6 is raised and lowered using lift cords 14 the lower edge 201*b* of shade 201 is also raised and lowered. Shade 201 may be made of a translucent material to allow some light to pass through the shade while shade 6 may be made more opaque to prevent light from passing through. In this manner the shade may selectively control the amount of light passing through it.

Figure 3:
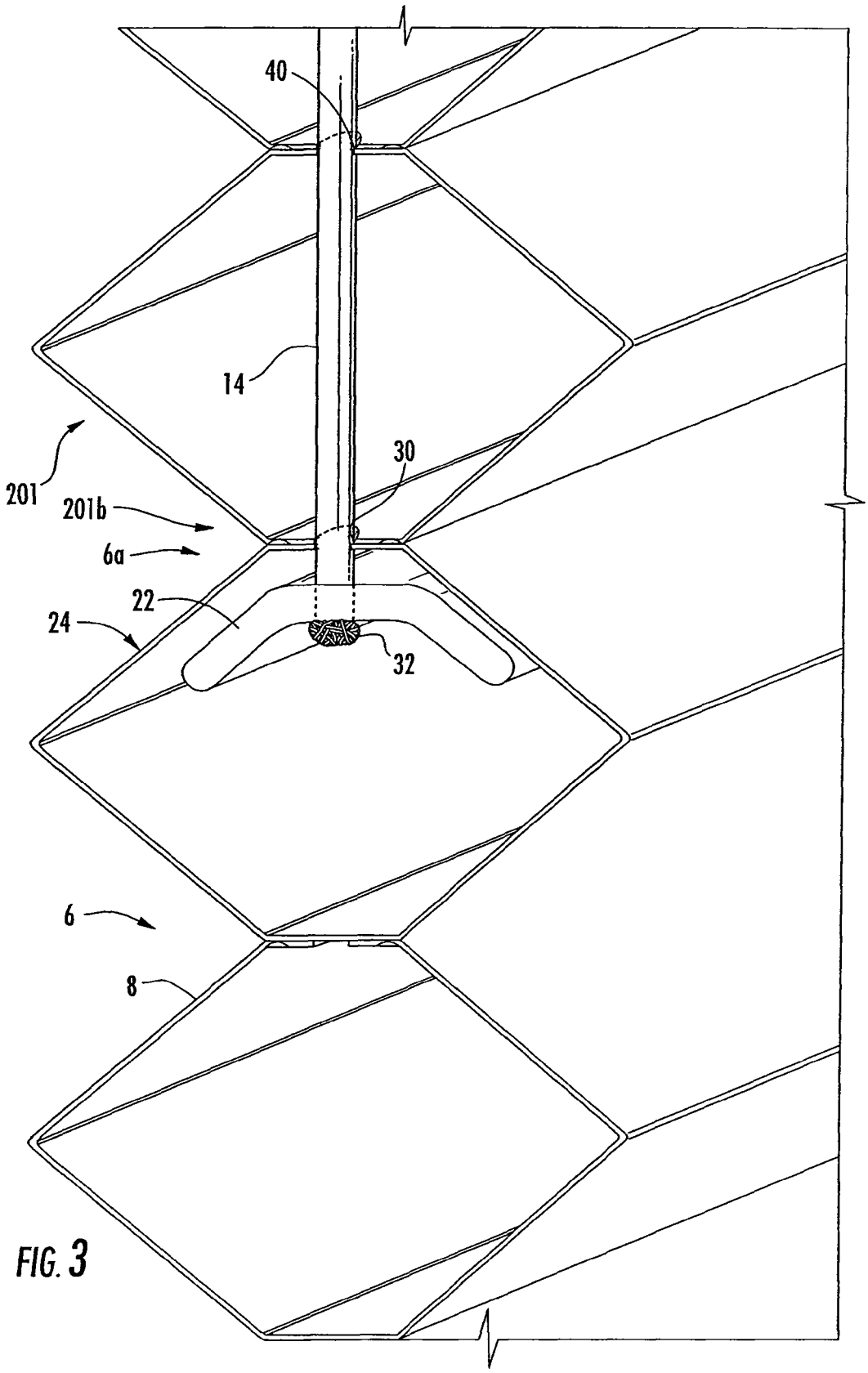
FIGS. 3 and 4 are perspective section views showing the attachment of the lift cord to the bar in a day/night shade like that illustrated in FIG. 2.
Figure 4:
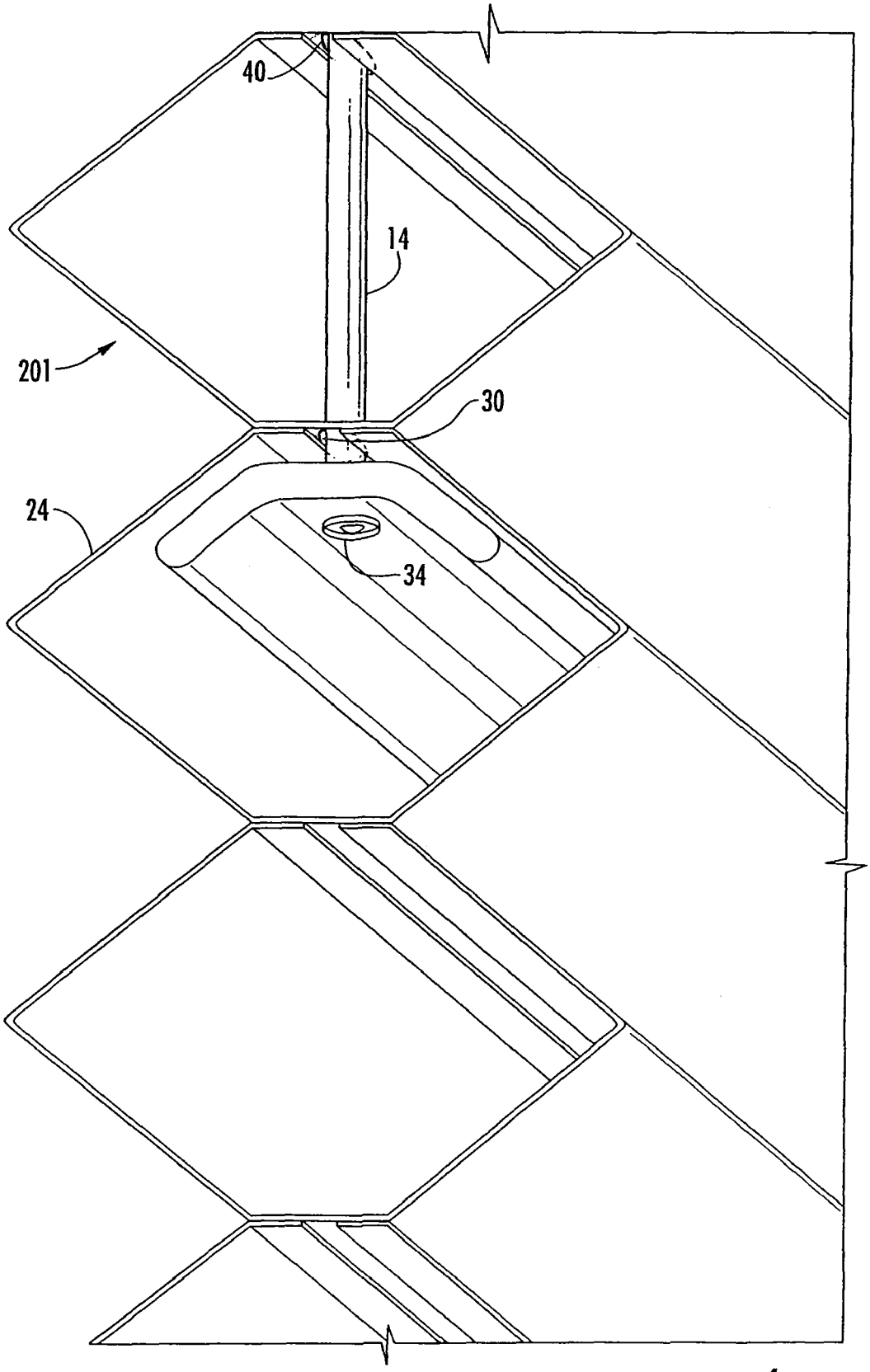

Referring to FIGS. 3, 4 and 5, to raise and lower the upper edge 6*a* of panel 6 the lift cords 14 are connected to rigid bar 22 that is located within the uppermost cell 24 of panel 6. The uppermost cell is the cell located nearest to the upper edge 6*a* of the panel 6. Because the blind illustrated in FIGS. 3, 4 and 5 is a day/night shade the lower cells of panel 201 are shown where the lower edge 201*b* of panel 201 is connected to the uppermost cell 24 of panel 6. In the top down/bottom up shade of FIG. 1, panel 201 is eliminated. In either configuration, the arrangement of bar 22, cell 24 and lift cords 12 and 14 is generally the same such that reference will be made to the day/night configuration for purposes of explanation.

Rigid bar 22 comprises a rigid member that extends for substantially the entire width of the panel 6. Bar 22 may be made of aluminum, rigid plastic, wood or other rigid material. As best shown in FIG. 5, the profile of rigid bar 22 is formed to conform, at least partially, to the shape of cell 24. In one embodiment the upper surfaces 22*a* of bar 22 conform to the shape of the upper surfaces 24*a*, 24*b*, and 24*c* of the cell 24 such that the top faces of cell 24 are supported by the bar 22 in such a manner that the bar 22 helps to maintain the shape of the cell 24. The weight of panel 6 is supported by the engagement of cell 24 on top of bar 22. By shaping bar 22 to conform to the desired shape of cell 24, cell 24 is supported so that its external appearance that is the same as the other cells in panel 6. The bar 22 may also be formed to conform to the entire interior shape of the cell. In such an arrangement cell 24 could not collapse when the blind is retracted. By providing the bar 22 adjacent only to the upper faces of the cell 24 the cell may partially collapse when the blind is retracted yet bar 22 supports the cell so as to maintain the shape of the cell. Other arrangements are also possible. For example, bar 22 could be made flat and support only surface 24*b* of cell 24.

Referring to FIGS. 3 and 4, the lift cords 14 extend through apertures 30 formed in the top of cell 24 and are connected to the bar 22 internally of the cell 24. The lift cords may be connected to the bar by any suitable means where the movement of the lift cord results in the lifting or lowering of the bar. For example the lift cord may extend though an aperture formed in the bar 22 and a knot 32 can be tied in the end of the lift cord (shown in FIG. 3) to prevent it from being withdrawn back through the aperture. The lift cord may also be secured to a fastener 34 (shown in FIG. 4) to secure it to the bar. Alternatively, the lift cord may be secured to the bar by an adhesive or any other securing device. In a day/night shade the lift cords 14 also pass through apertures 40 formed in the cells of shade panel 201.

Referring to FIG. 5, the lift cords 12 also extend through apertures 36 formed in the top cell 24. The lift cords 12 also pass through apertures 38 formed in the bar 22. Lift cords 12 extend through apertures formed in each of the other cells 8 and are connected to the bottom rail 10 such that the raising and lowering of the lift cords 12 result in the raising and lowering of the bottom rail 10 without moving bar 22.

By placing the support bar 22 within the cell 24, the outward appearance of the panel 6 has a uniform appearance from its upper edge 6*a* to the bottom rail 10. Moreover, in a top down/bottom up shade when the upper edge 6*a* of the panel 6 is in its completely raised position the top edge of cell 24 abuts the head rail to create an appearance that is the same as a traditional bottom up shade. Further, the upper edge 6*a* of the panel 6 can be brought into tight engagement with the head rail 2 to minimize light gaps. In a day/night shade the upper cell 24 may have the same shape as the cells of both the top panel 201 and the bottom panel 6 such that a continuous length of cells is presented uninterrupted by a middle rail.

It is also possible to place the bar 22 in a cell other than the top cell 24. For example the bar 22 may be placed in the second cell from the top edge 6*a* such that the upper most cell 24 simply rides on top of the cell in which the bar 22 is located.

Specific embodiments of an invention are described herein. One of ordinary skill in the art will recognize that the invention has other applications in other environments. In fact, many embodiments and implementations are possible. The following claims are in no way intended to limit the scope of the invention to the specific embodiments described above.

The invention claimed is:

1. A window covering comprising:

a stationary head rail adapted to be fixed to an architectural feature;

a shade panel having a width, an upper edge and a lower edge, said shade panel comprising an upper cell located at the upper edge and a plurality of substantially similarly configured other cells having a first outward configuration, said plurality of other cells being connected to said upper cell, each of said upper cell and said plurality of other cells comprising a plurality of faces defining a collapsible open interior;

a rigid bar located substantially entirely in the interior of said upper cell such that said upper cell has a second outward configuration that is substantially the same as the first outward configuration of the plurality of other cells; and a lift cord extending from said head rail and directly connected to said bar for moving the upper edge relative to the head rail.

2. The window covering of claim 1 wherein said lift cord extends through said shade panel.

3. The window covering of claim 1 wherein a second lift cord is connected to said bar.

4. The window covering of claim 1 wherein a third lift cord extends through said bar.

5. The window covering of claim 4 further including a bottom rail attached to the lower edge, wherein said third lift cord is connected to the bottom rail.

6. The window covering of claim 1 wherein a second panel is located between said shade panel and said head rail.

7. The window covering of claim 6 wherein the second panel has a different light translucency than said shade panel.

8. The window covering of claim 1 wherein the bar conforms to the shape of the upper cell.

9. The window covering of claim 1 wherein the upper cell has a first face and a second face defining an upper portion of the upper cell, said bar including a third face and a fourth face that conform to the first face and the second face.

10. The window covering of claim 1 wherein the bar is aluminum.

11. The window covering of claim 1 wherein the bar is plastic.

12. The window covering of claim 1 wherein the plurality of other cells are arranged substantially parallel to the upper cell.

13. The window covering of claim 12 wherein the upper cell and the plurality of other cells are made of fabric.

14. A method of manufacturing a window covering comprising:

providing a head rail;

providing a shade panel having a width, an upper edge and a lower edge, said shade panel comprising an upper cell located toward the upper edge and a plurality of other cells, said upper cell and said plurality of other cells include a plurality of faces forming collapsible cells having substantially similar outward configurations;

locating a rigid bar entirely internally of said upper cell; and directly connecting a lift cord between said head rail and said bar for moving the upper edge relative to the head rail.

15. A window covering comprising:

a head rail;

a shade panel having a width, an upper edge and a lower edge, and a front side and a back side, said shade panel comprising an upper cell located at the upper edge and a plurality of other cells connected to said upper cell, said shade panel being defined by said upper cell and said plurality of other cells, said upper cell comprising a plurality of faces each of said faces being directly joined to an adjacent face along a fold line;

a rigid bar located internally of said upper cell for supporting said shade panel such that said upper cell may partially collapse and the outward appearance of the shade panel is uniform from its upper edge to its lower edge on both the front side and the back side; and a lift cord extending from said head rail and directly connected to said bar for moving the upper edge relative to the head rail.

16. A window covering comprising:

a stationary head rail;

a shade panel movable between a first position and a second position and having a width, an upper edge and a lower edge, and a front side and a back side, said shade panel comprising an upper cell located at the upper edge and a plurality of substantially similarly shaped other cells connected to said upper cell, said upper cell and said plurality of other cells each defined by a plurality of faces joined at fold lines to define an open interior space such that said upper cell and said plurality of other cells are in a first expanded configuration when the shade panel is in the first position and said faces move along said fold lines relative to one another to a second relatively collapsed configuration when the shade panel is in the second position, said upper cell extending along the width of the shade panel comprising a cell upper surface;

a rigid bar located internally of said upper cell such that the bar is located in said open space such that the external appearance of the upper cell and the other cells are substantially identical on both the front side and the back side, said bar partially conforming to the shape of said upper cell and having a bar upper surface such that the weight of the shade panel is supported by the engagement of the cell upper surface on top of said bar upper surface; and a lift cord extending from said head rail and through said upper surface, said lift cord being directly connected to said bar for supporting the upper cell and moving the upper edge relative to the head rail.

* * * * *